US010028601B2

(12) United States Patent
Lo

(10) Patent No.: US 10,028,601 B2
(45) Date of Patent: Jul. 24, 2018

(54) COMPUTER PILLOW STAND

(71) Applicant: Jack Lo, Redwood City, CA (US)

(72) Inventor: Jack Lo, Redwood City, CA (US)

( * ) Notice: Subject to any disclaimer, the term of this patent is extended or adjusted under 35 U.S.C. 154(b) by 290 days.

(21) Appl. No.: 15/196,026

(22) Filed: Jun. 28, 2016

(65) Prior Publication Data

US 2017/0367508 A1 Dec. 28, 2017

(51) Int. Cl.

| | |
|---|---|
| ***A47B 23/00*** | (2006.01) |
| ***A47G 9/10*** | (2006.01) |
| ***G06F 1/16*** | (2006.01) |

(52) U.S. Cl.

CPC ..... *A47G 9/1045* (2013.01); *A47G 9/1009* (2013.01); *G06F 1/166* (2013.01)

(58) Field of Classification Search

CPC ..... A47B 23/00
USPC ..... 5/639–640
See application file for complete search history.

(56) References Cited

U.S. PATENT DOCUMENTS

| | | | | |
|---|---|---|---|---|
| 2,505,615 | A | 4/1950 | Glass | |
| 5,350,147 | A | 9/1994 | Paganus | |
| D362,565 | S * | 9/1995 | Tubbs | D6/310 |
| 5,623,869 | A * | 4/1997 | Moss | A47B 23/002 108/43 |
| 6,270,050 | B1 | 8/2001 | Friedrich | |
| 6,439,530 | B1 | 8/2002 | Schoenfish et al. | |
| 7,502,225 | B2 * | 3/2009 | Solomon | G06F 1/1632 361/679.41 |
| 7,988,106 | B2 | 8/2011 | Carnevali | |
| D676,832 | S | 2/2013 | Akana et al. | |
| 8,376,303 | B2 | 2/2013 | Yang et al. | |
| D687,833 | S | 8/2013 | Gittins | |
| 8,534,617 | B2 | 9/2013 | Wang et al. | |
| D701,212 | S | 3/2014 | Blevins | |
| D701,213 | S | 3/2014 | Pajic | |
| 8,672,125 | B2 | 3/2014 | Sween et al. | |
| 8,757,374 | B1 | 6/2014 | Kaiser | |
| D711,890 | S | 8/2014 | Stener | |
| D715,804 | S | 10/2014 | Frenzel | |

(Continued)

OTHER PUBLICATIONS

Web page for 3PX USA iPad Stand Wedge Lap Pillow Designed for Tablet, downloaded on Jul. 19, 2014.

(Continued)

*Primary Examiner* — Fredrick C Conley

(57) ABSTRACT

A mobile computer such as tablet computer or mobile phone typically lacks built-in structure for standing up on its own. The user must hold it up by hand during use. The present invention is a pillow stand for mobile computers that may be comfortably placed on the lap of a user. It includes an outer shell enclosing a soft filler. A gripping member is positioned on the outer shell for supporting the computer in a backwardly tilting free-standing position. A stabilizing plate is positioned under the outer shell and connected to the gripping member. The stabilizing plate is engaged against the filler to spread the weight of the computer across a large enough area of the soft filler to stably support the computer. The gripping member includes a slot for receiving a lower edge of the computer. An adjusting device connected to the slot is operable to change the width of the slot and thus the tilt and viewing angle of the computer. The pillow stand also lifts the computer higher for reducing neck strain.

7 Claims, 5 Drawing Sheets

(56) References Cited

U.S. PATENT DOCUMENTS

| | | | |
|---|---|---|---|
| 2007/0152117 | A1 | 7/2007 | Byrd |
| 2011/0210224 | A1 | 9/2011 | Piccolo |
| 2013/0027871 | A1 | 1/2013 | Cheng |

OTHER PUBLICATIONS

Web page for Digital Gadgets iCozy Bean Bag Stand for Tablets, downloaded on Jul. 19, 2014.
Web page for GoGo Pillow, downloaded on Jul. 19, 2014.
Web page for IPEVO PadPillow Pillow Stand, downloaded on Jul. 19, 2014.
Web page for iProp Bean Bag Universal Tablet Holder, downloaded on Jul. 19, 2014.
Web page for Lap Log Classic iPad Stand Touchscreen Tablet Holder, downloaded on Jul. 19, 2014.
Web page for LapGear 35051 SuperSoft Tablet Pillow, downloaded on Jul. 19, 2014.
Web page for padRelax—iPad Pillow Stand Holder, downloaded on Jul. 19, 2014.
Web page for Prop 'n Go Slim—Adjustable Bed Holder & Lap Stand, downloaded on Jul. 19, 2014.

* cited by examiner

COMPUTER PILLOW STAND

BACKGROUND OF THE INVENTION

Field of the Invention

This invention relates to stands for mobile computers.

Prior Art

A mobile computer such as tablet computer or mobile phone typically lacks built-in structure for standing up on its own. Tabletop stands are available for propping up a mobile computer on a desk. They support the computer with its lower edge very close to the desk. This low position requires the user to look down and may cause neck strain. Tabletop stands have narrow bases or feet that require a flat and stationary supporting surface. They are not practical for use on a user's lap.

At home, people often use mobile computers while sitting on a sofa or in bed. When the computer is placed on a lap, it is usually held by one hand and operated by the other hand. The hand holding the computer may get tired and the low position of the computer may cause neck strain.

Padded stands specifically designed for supporting a mobile computer on a user's lap or bed are also available. Some padded stands have a hard top surface with a slot at a fixed angle for receiving a computer. The hard surface is uncomfortable for supporting the hands and arms. Some padded stands have brackets for securing four corners of the computer. Most padded stands have a ledge or slot at a lower front edge for supporting the computer, and most of the stand is behind the computer. The computer sits very low in front of the stand so neck strain may result. Most prior art stands have no support for the hands.

Although padded stands are sometimes referred to as "pillow stands", they do not look or feel like regular pillows. They are either relatively rigid and/or oddly shaped, and they do not blend in with throw pillows on a sofa or bed pillows on a bed.

BRIEF SUMMARY OF THE INVENTION

A computer pillow stand includes an outer shell enclosing a soft filler. A gripping member is positioned on the outer shell for supporting a mobile computer in a backwardly tilting free-standing position. A stabilizing plate is positioned between the outer shell and the filler, and is connected to the gripping member through the outer shell. The stabilizing plate is engaged against the filler to spread the weight of the computer across a wide area of the soft filler to stably support the computer. The gripping member includes a slot for receiving a lower edge of the computer, and an adjusting device operable to change the width of the slot and thus the tilt and viewing angle of the computer. The pillow stand also lifts the computer higher for reducing neck strain.

DETAILED DESCRIPTION OF THE DRAWINGS

Figure 1:
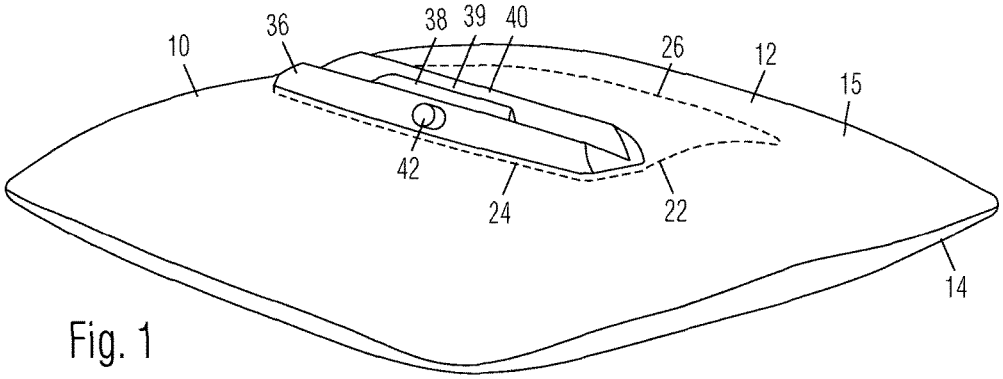
FIG. 1 is a perspective view of a computer pillow stand.

FIG. 1 shows a computer pillow stand according to the invention. It includes a soft pillow 10 with a flexible top panel 12 connected to a flexible bottom panel 14 joined to form an outer shell 15. Pillow 10 is a throw pillow that blends in with typical home décor.

A gripping member 36 is attached to the outside of pillow 10. Gripping member 36 includes a movable front tab 38 spaced apart from a rear tab 40 to define a transverse slot 39 there between. Front tab 38 is movable in a longitudinal direction towards or away from rear tab 40 by operating an adjusting device 42. Alternatively, the front tab may be fixed and the rear tab may be movable. In this example, adjusting device 42 is a rotary knob. A stabilizing plate 22 is positioned inside pillow 10. Stabilizing plate 22 includes a front portion 24 attached to gripping member 36, and a rear portion 26 extending rearwards under top panel 12.

Figure 2:
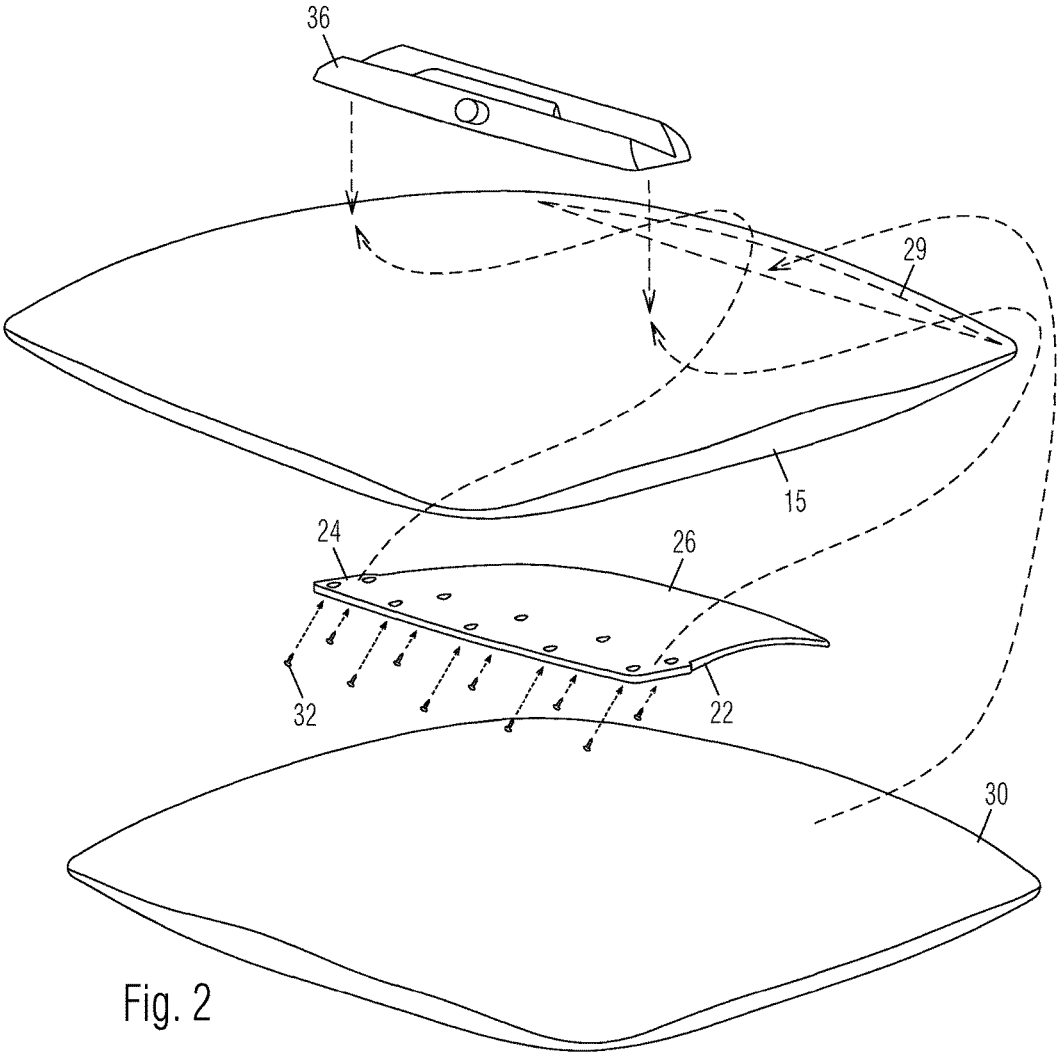
FIG. 2 is an exploded view of the pillow stand.

FIG. 2 is an exploded view of the pillow stand. Gripping member 36 is for attaching to the outside of outer shell 15. Stabilizing plate 22 is for positioning inside outer shell 15 through a zipper 29. Front portion 24 of stabilizing plate 22 is secured to gripping member 36 with fasteners or screws 32 that extend through outer shell 15. A soft filler 30 is for positioning inside outer shell 15 through zipper 29.

Figure 3:
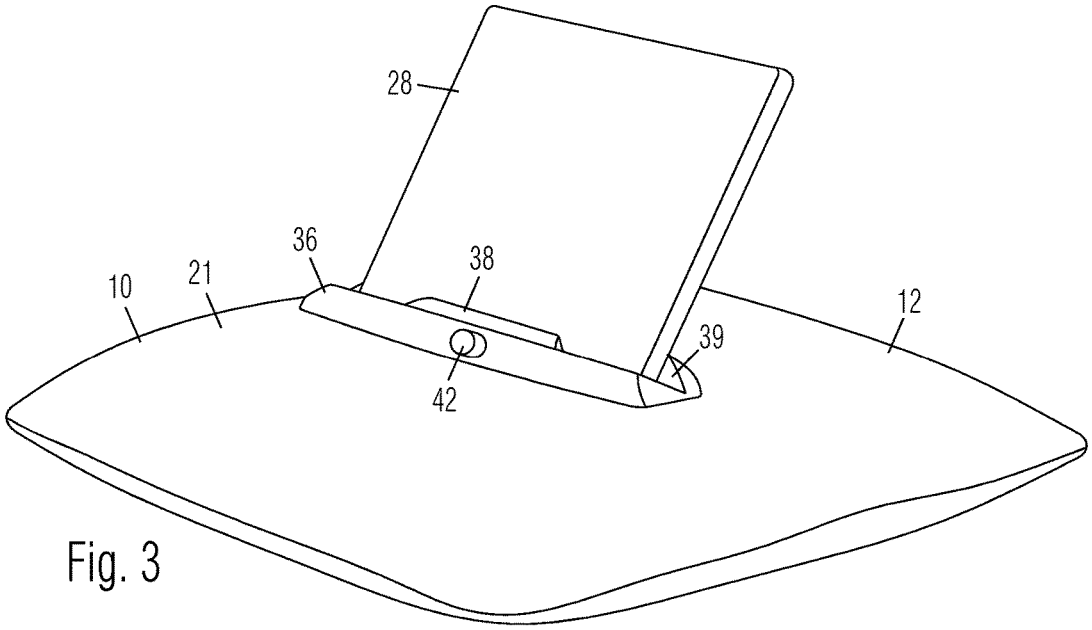
FIG. 3 is a perspective view of the pillow stand supporting a computer.

FIG. 3 shows a mobile computer 28 such as tablet computer or mobile phone positioned in slot 39 of gripping member 36. Soft pillow 10 may be comfortably placed on the lap of a user. Gripping member 36 is positioned at the top of pillow 10 for lifting computer 28 as high as possible and closer to eye level to reduce neck strain. Gripping member 36 is positioned at about the middle of top panel 12, so that the area in front of computer 28 serves as a soft hand rest 21.

Figure 4:
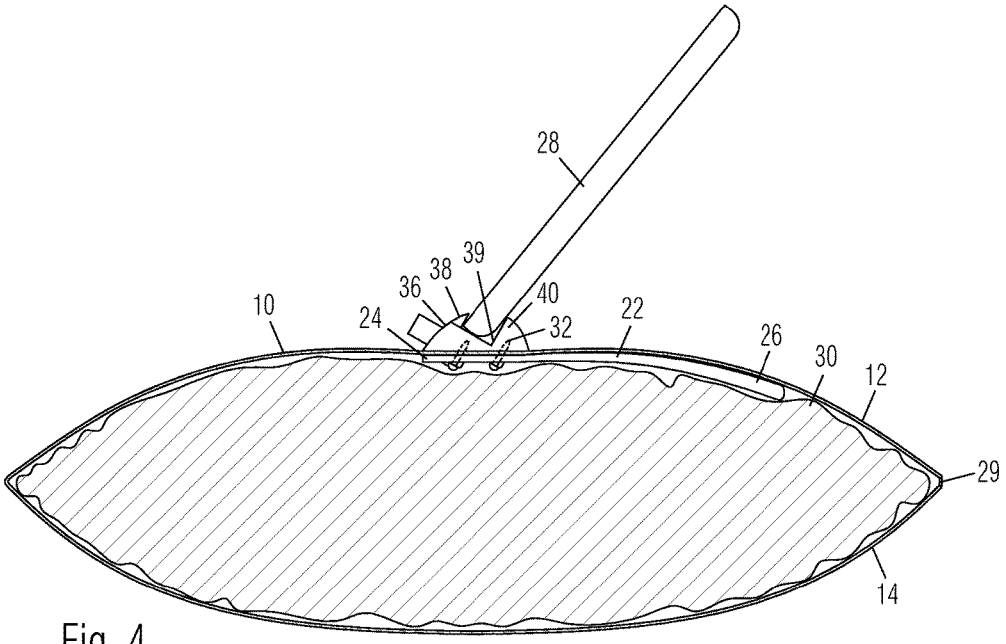
FIG. 4 is a sectional view of the pillow stand.

FIG. 4 is a sectional view of the pillow stand. Front tab 38 and rear tab 40 of gripping member 36 are angled rearward to define rearward angled slot 39. When computer 28 is positioned in slot 39, it is tilted backwards for better viewing. Rear portion 26 of stabilizing plate 22 is curved to follow the contour of top panel 12.

Figure 5:
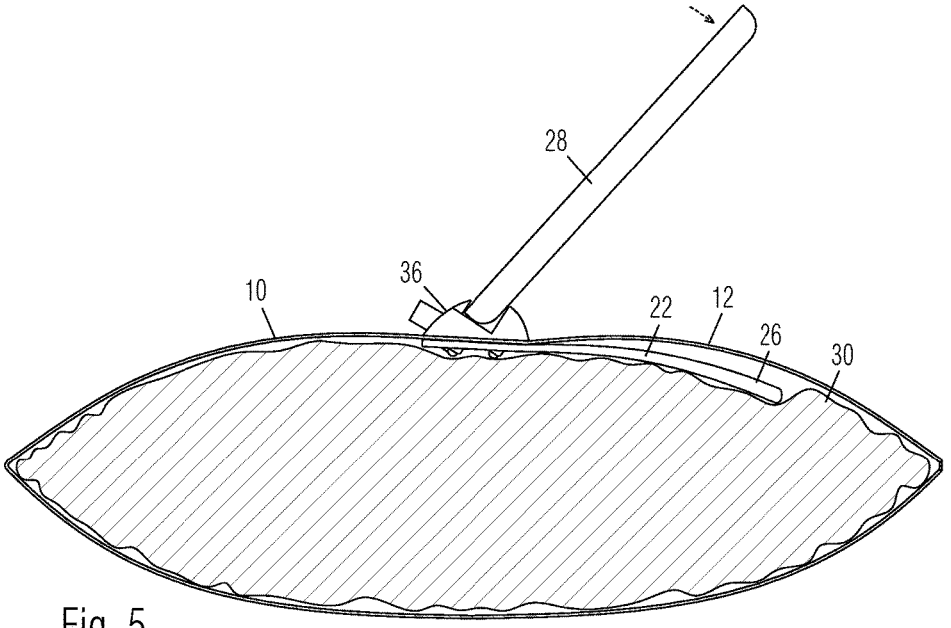
FIG. 5 is a sectional view of the pillow stand.

FIG. 5 shows that when computer 28 is received in gripping member 36, it tends to fall backwards slightly. The twisting force applied to gripping member 36 by computer 28 is resisted by rear portion 26 which is pressed against filler 30. Rear portion 26 spreads the force over a wide area of filler 30. Rear portion 26 is not attached to top panel 12 so no that it is free to move slightly away when pressing down on filler 30.

Figure 6:
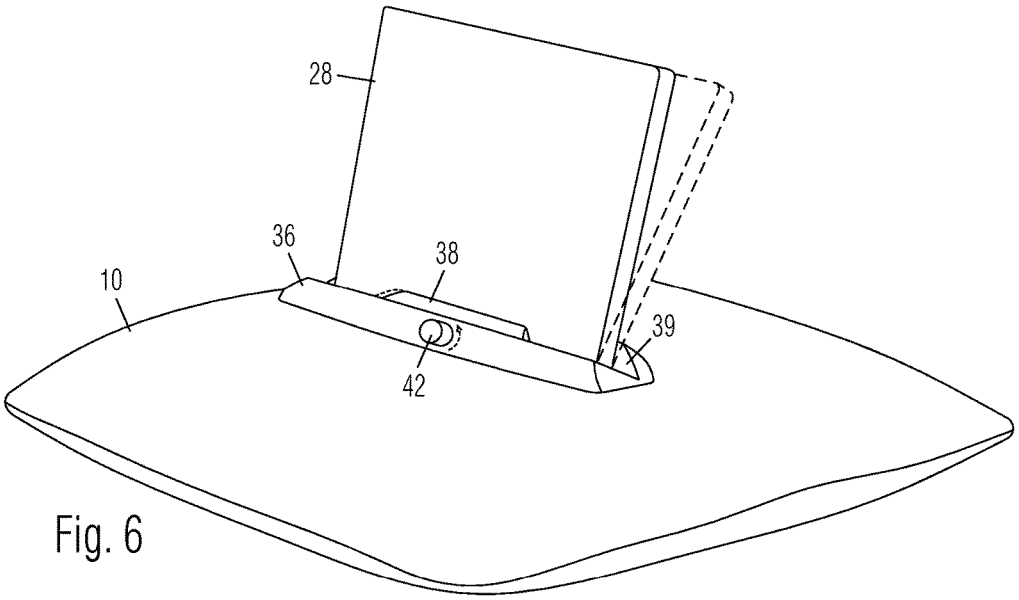
FIG. 6 is a perspective view of the pillow stand supporting the computer more upright.

FIG. 6 shows front tab 38 moved inwards by operating adjusting device 42. This action narrows slot 39 and makes computer 28 stand more upright.

Figure 7:
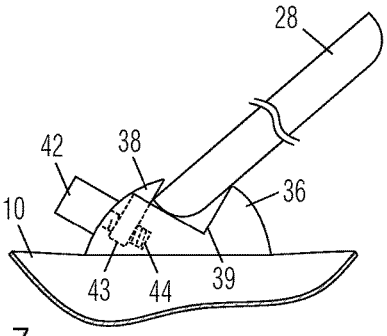
FIG. 7 is a side view of a gripping member of the pillow stand supporting the computer in the position in FIG. 3.

FIG. 7 shows that an inner portion of knob or adjusting device 42 is a threaded shaft 44 connected to an inner end 43 of front tab 38. Turning adjusting device 42 moves front tab 38 along the length of shaft 44 to adjust the position of front tab 38 and thus the width of slot 39. In FIG. 7, front tab 38 in its most outward position and slot 39 in its widest condition. When slot 39 is adjusted to be wider than the thickness of computer 28, the computer is more inclined backwards as shown. Slot 39 is generally U-shaped when seen from the side.

Figure 8:
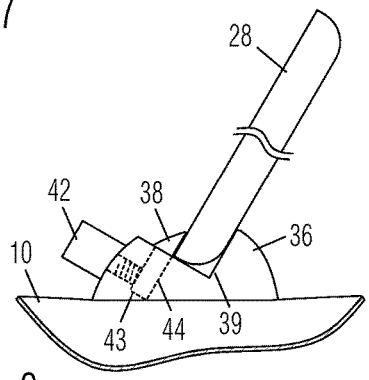
FIG. 8 is a side view of the gripping member supporting the computer in the more upright position in FIG. 6.

FIG. 8 shows front tab 38 moved inward to narrow slot 39 by rotating adjusting device 42. When slot 39 is narrowed, computer 28 is raised more upright as shown. Therefore the viewing angle of computer 28 may be changed with adjusting device 42. The width of slot 39 may also be changed to receive a computer thickened with a protective case.

Figure 9:
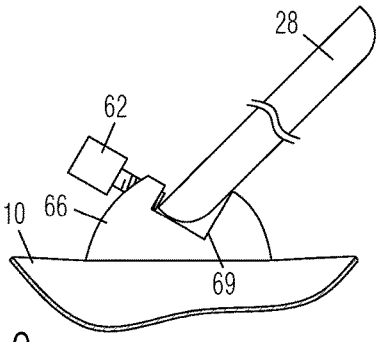
FIG. 9 is a side view of an alternative gripping member supporting the computer in a relatively inclined position.

FIG. 9 is a side view of an alternative gripping member 66 with a U-shaped slot 69 for receiving computer 28. An adjusting device 62, which in this example is a threaded knob, movably extends into slot 69. Adjusting device 62 is operable to extend into slot 69 to vary an effective width of slot 69 and alter the viewing angle of computer 28. In FIG. 9, adjusting device 62 is moved to its outer most position and the effective width of slot 69 is at its widest, therefore computer 28 is relatively inclined backwards.

Figure 10:
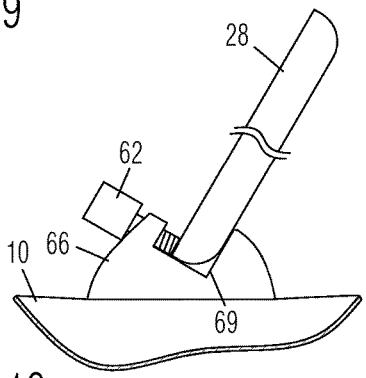
FIG. 10 is a side view of the alternative gripping member supporting the computer in a relatively upright position.

FIG. 10 shows alternative gripping member 66 with adjusting device 62 moved to its inner most position to narrow slot 69, therefore computer 28 is relatively upright.

I claim:

1. A computer pillow stand, comprising:

a flexible outer shell with a zipper;

a soft filler enclosed within the outer shell;

a gripping member with a slot on the outside of the outer shell for receiving a lower edge of a mobile computer and supporting the computer in a free-standing position; and a stabilizing plate positioned between the outer shell and the filler and connected to the gripping member with fasteners extending through the outer shell, wherein the stabilizing plate has a rear portion extending backwards from the gripping member and curved to follow a contour of the outer shell, the rear portion of the stabilizing plate is supported by the filler for maintaining the computer in the free-standing position.

2. The pillow stand of claim 1, wherein the fasteners comprise screws piercing the outer shell.

3. A computer pillow stand, comprising:

a flexible outer shell enclosing a soft filler;

a gripping member on the outside of the outer shell for supporting a mobile computer in a free-standing position;

a slot on the gripping member for receiving a lower edge of the computer; and an adjusting device connected to the slot and operable to vary a width of the slot for changing the tilt and viewing angle of the computer.

4. The pillow stand of claim 3, wherein the adjusting device comprises a knob with a threaded shaft.

5. The pillow stand of claim 3, further including a stabilizing plate between the outer shell and the filler, wherein the stabilizing plate is connected to the gripping member with fasteners extending through the outer shell, the stabilizing plate has a rear portion extending backwards from the gripping member and supported by the filler.

6. The pillow stand of claim 3, further including a zipper on the outer shell.

7. A computer pillow stand, comprising:

an outer shell with a zipper;

a soft filler enclosed within the outer shell;

a gripping member on the outside of the outer shell for supporting a mobile computer in a free-standing position; and a stabilizing plate between the outer shell and the filler, wherein the stabilizing plate is connected to the gripping member with fasteners extending through the outer shell, the stabilizing plate has a rear portion extending backwards from the gripping member and supported by the filler; wherein a slot on the gripping member for receiving a lower edge of the computer; and a knob with a threaded shaft connected to the the slot and operable to vary a width of the slot for changing the tilt and viewing angle of the computer.

* * * * *